United States Patent [19]

Chuan

[11] Patent Number: 4,472,174

[45] Date of Patent: Sep. 18, 1984

[54] METHOD AND APPARATUS FOR PROVIDING AND USING RF GENERATED PLASMA FOR PARTICLE CHARGING IN ELECTROSTATIC PRECIPITATION

[75] Inventor: Raymond L. Chuan, Huntington Beach, Calif.

[73] Assignees: Raymond L. Chuan, Huntington Beach; Robert H. Stivers, Westlake Village; John D. Tuttle, Huntington Beach, all of Calif.

[21] Appl. No.: 488,416

[22] Filed: Apr. 25, 1983

[51] Int. Cl.[3] ..... B03C 3/12

[52] U.S. Cl. ..... 55/5; 55/105; 55/138

[58] Field of Search ..... 55/2, 3, 5, 105, 138, 55/101; 361/229, 231, 230; 250/423 R; 315/111.41, 111.51; 313/231.41, 362.1

[56] References Cited

U.S. PATENT DOCUMENTS

| | | | |
|---|---|---|---|
| 2,826,708 | 3/1958 | Foster, Jr. | 250/423 R |
| 2,934,665 | 4/1960 | Ziegler | 313/362.1 |
| 3,173,248 | 3/1965 | Curtis et al. | 55/101 |
| 3,173,298 | 3/1965 | Gilmont | 73/401 |
| 3,376,469 | 4/1968 | Consoli et al. | 250/423 R |
| 3,443,358 | 5/1969 | Drenning et al. | 55/2 |
| 3,625,846 | 12/1971 | Murdoch et al. | 55/2 |
| 3,715,625 | 2/1973 | Ehlers | 361/230 |
| 4,214,187 | 7/1980 | Mourier | 250/423 R |

FOREIGN PATENT DOCUMENTS

| | | | |
|---|---|---|---|
| 1212228 | 3/1966 | Fed. Rep. of Germany | 250/423 R |
| 115113 | 9/1980 | Japan | 315/111.41 |

*Primary Examiner*—David L. Lacey

*Attorney, Agent, or Firm*—William W. Haefliger

[57] ABSTRACT

Method and apparatus for employing a plasma produced in a radio-frequency discharge to enhance electrostatic precipitation. The plasma is generated in an auxiliary gaseous stream, and the plasma is introduced into a primary fluid stream flowing toward or in an electrostatic precipitation zone. The plasma causes ionization of the auxiliary gaseous stream, and the ionized gaseous stream charges the particles in the primary fluid stream. The primary fluid stream in which the particles are entrained flows in a primary duct toward an electrostatic precipitator containing the precipitation zone. A plasma generator generates plasma in the auxiliary gaseous stream to cause ionization thereof; and a secondary duct conducts the plasma into the primary stream for charging particles in the primary fluid stream. The charged particles then flow in the primary fluid stream into the precipitator.

17 Claims, 3 Drawing Figures

METHOD AND APPARATUS FOR PROVIDING AND USING RF GENERATED PLASMA FOR PARTICLE CHARGING IN ELECTROSTATIC PRECIPITATION

BACKGROUND OF THE INVENTION

This invention relates generally to removal of gas-borne fine dust, or particulate, or aerosol particles, from gaseous streams. More particularly, it concerns improved method and apparatus for achieving such separation, and employing use of plasma to enhance electrostatic precipitation.

Electrostatic precipitators have been in use for many decades as means for the removal of gas-borne fine dust or aerosol particles. In conventional precipitators the particles become electrically charged by the accretion of ions or electrons on their surfaces. The ions or electrons are usually produced by the creation of a discharge in the gas, in which the particles are entrained or suspended, by the imposition of a high DC electric field. The type of electrical discharge for the production of the ions and electrons which subsequently attach to the particles, is a glow discharge, which is a low current discharge. However; since a glow discharge can become an arc, which is a very high current discharge, it becomes necessary in conventional electrostatic precipitators to carefully control the field strength so as to maintain the discharge just below arcing. Large systems are typically designed to bring the discharge just to arcing and then reduce the field strength, to quench the arc, and then again increasing the field strength, thus repeating the cycle continually. This is not a very efficient or effective way of achieving the production of ions in a gas as it requires complex switch gear; the ionization is produced only in a narrow region, and ozone is usually and undesirably produced because of the arcing. Typically it requires on the order of 1 kw electrical power for 1000 $ft^3$/min of gas flow through the precipitator.

SUMMARY OF THE INVENTION

The new method, herein described, deals with the production of ions and electrons in the gas in which dust particles are suspended, in a way which is more efficient, in terms of power requirements and spatial distribution of the ions and electrons and can eliminate the production of ozone. Furthermore, the method can be varied so as to be tailored to specific types of fine particles to effect the most efficient particle charging and capture.

The new method involves the separate production of a relatively low density plasma in a radio-frequency discharge; the plasma is stripped of its electrons while flowing through an r.f. discharge. The stream of ions and electrons is then mixed with the dust-laden stream wherein charge attachment takes place. The charged particles are subsequently deposited on cathode surfaces in the precipitator. The charge-carrying plasma can be produced from any convenient gas, especially one that does not contain oxygen such as nitrogen gas, which is inexpensive. By experiments one can also establish the best types of ions to use for attachment to specific types of particulates. The flue gas itself can be used to generate the ions, in which case the r.f. excitation means can be placed directly inside the flue gas stream.

An important difference between a DC discharge and an r.f. discharge is, in the latter case, the absence of electrodes in direct contact with the gas, hence the term "electrode-less" discharge. The ability to configure the electric field geometrically to suit the requirement of a particular application, and to select an r.f. frequency best suited for the selected combination of geometry and gas type makes it possible to effect gas ionization with the least possible power expenditure, as well as complete control over the discharge.

The ability to exert control over the r.f. discharge also makes it possible to remove most of the electrons from the resultant plasma, thus reducing the possibility of electron-ion recombination, which is a loss mechanism as far as the use of ions for attachment to particles is concerned. With electrons removed, the positively charged ions spread out due to mutual repulsion, thus aiding in the dispersion of the ions among the particles once the ion stream is injected into the flue gas stream.

These and other objects and advantages of the invention, as well as the details of an illustrative embodiment, will be more fully understood from the following specification and drawings, in which:

DRAWING DESCRIPTION

DRAWING DESCRIPTION

Figure 1:
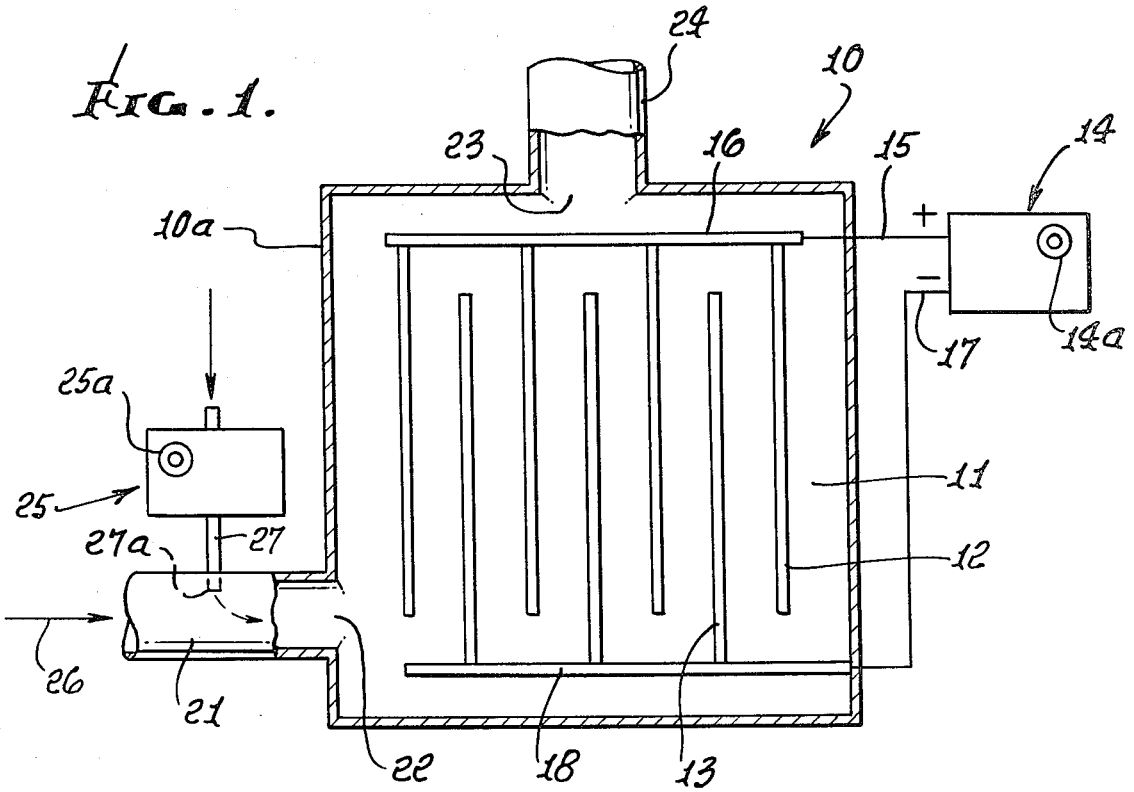
FIG. 1 is an elevation view showing one form of apparatus embodying the invention.

In FIG. 1, an electrostatic precipitator is shown at 10, and includes a housing 10*a* containing a precipitation chamber 11. Located in the latter are anode surfaces 12 and cathode surfaces 13, these being defined for example by elongated metallic elements which are spaced apart. A DC voltage supply unit 14 includes positive output terminal 15 connected at 16 with the anodes, and a negative terminal 17 connected at 18 with the cathodes. The DC voltage output may be suitably varied as at 14*a*. Gas or fluid containing particulate is supplied via duct 21 and inlet 22 to the chamber 11, and clean gas exits the chamber via outlet 23 and duct 24. Other forms of electrostatic precipitators may be employed, the one shown in FIG. 1 being illustrative only.

In accordance with the invention, apparatus is provided to enhance the precipitation of particles entrained in the primary fluid or gas stream flowing toward or in the precipitation zone in the chamber 11. Such apparatus is shown as in FIG. 1 to include first means 25 for generating a plasma in an auxiliary gaseous stream, and second means to communicate with the primary stream 26 for conducting the plasma into the latter. Such second means may for example include duct 27 having an oulet 27*a* exposed to the primary stream to conduct the plasma to the latter. The first means 25 may typically produce an r.f. discharge. A control means, indicated at 25*a* is provided to control the frequency of r.f. energy supplied to produce the discharge, and in relation to the strength of the DC field referred to above, thereby to optimize the particle precipitation, as well as minimize total energy consumption. The frequency is typically controllable between about 1 Mhz and 10 Ghz. Further in this regard, the DC voltage producing the DC field may itself be controlled, as by manual control 14*a*, to control the strength of the DC field produced between elements 12 and 13, to assist in such optimization. Typically, the DC field strength may be controlled to a level or levels well below arcing level.

Figure 2:
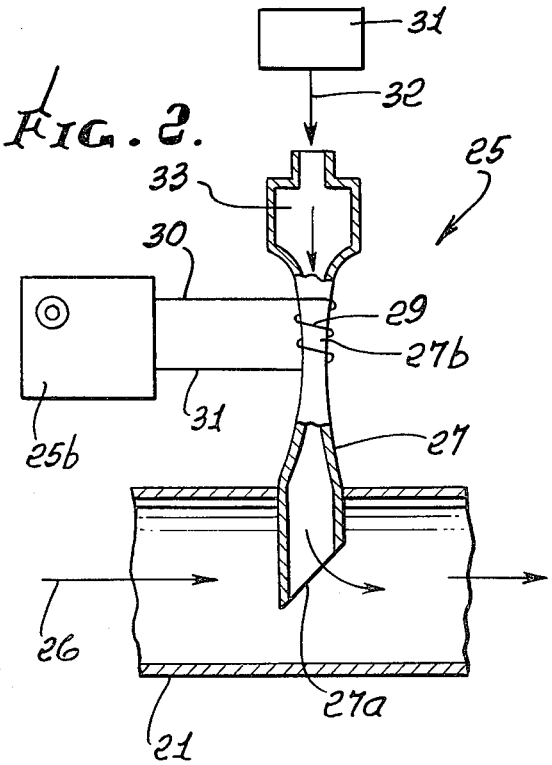
FIG. 2 is an elevation view showing one form of plasma generator.

More specifically, and as shown in FIG. 2, the first means 25 may include a coil 29 proximate (as for example extending about) a venturi section 27b of the duct 27, and a source 25b of r.f. energy connected with that coil (i.e. as via leads 30 and 31) to produce a high intensity electro magnetic field in an auxiliary gas stream flowing in the duct and toward outlet 27a near the center of duct 21 for mixing with the dust particle laden gas flowing at 26 in duct 21. In this regard, auxiliary means indicated at 31 may be employed to supply the auxiliary gas indicated at 32 (consisting essentially of air or nitrogen) to flow in side duct 27, for plasma production. Such auxiliary means may supply the gas 32 at selected pressure, as for example a pressure above that of the gas flow 26 in duct 21. A plenum chamber is indicated at 33, and aids in control of plasma production. If desired, electrons may be stripped from the plasma, in means 25 in FIG. 1, so that a net flow of positive ions into the gas stream 26 occurs, whereby collection of these positively charged dust particles is enhanced, in chamber 11.

Figure 3:
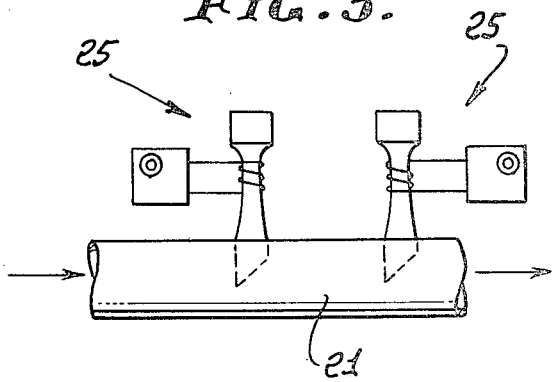
FIG. 3 is an elevation view showing a modification.

FIG. 3 shows a modification wherein multiple of the means 25 are employed, as shown.

A sample set of calculations below will illustrate the overall efficiency of the concept:

Assume: Flue gas containing 10 gram/m$^3$ of particulates with average size of 1 micron. (This is equivalent to about 4.5 grains/ft.$^3$ in particulate concentration). $C=10$ gm/m$^3=10^{-5}$ gm/cm$^3$.

At $1\mu$ diameter a particle with density of 2 gm/cm$^3$ has a mass of $10^{-12}$ gm. Therefore, the number density of particles at a mass density of $10^{-5}$ gm/cm$^3$ is $N_p=10^7$ part/cm$^3$.

If each particle takes on 100 ions the ion density is: $N_i=10^9$ 1/cm$^3$.

Suppose to take care of losses and inefficiency of ion-particles collisions, we assume the initial plasma charge density to be 100 times the required ion density. The plasma charge density is then:

$$Ne=10^2Ni=10^{11}\ 1/cm^3$$

In a radio-frequency discharge it is possible, without extremely high field strength, to achieve ionization of $10^{-4}$. Thus, if a gas at atmospheric density ($10^{19}$ 1/cm$^3$) is passed through the discharge, the resulting plasma charge density is:

$$N_p=10^{19-4}=10^{15}\ 1/cm^3$$

Since it has been established above that the required plasma charge density for charging the particles is $10^{11}$ 1/cm$^3$, the volume of plasma required to the volume of flue gas is then $$V_p/V_f=10^{11}/10^{15}=10^{-4}$$

Suppose nitrogen gas is used to produce the plasma (in order to avoid ozone production), the ionization energy required is then:

$$E_i=15.6\times1.6\times10^{-19}+2.5\times10^{-18}\ \text{joule}$$

The ionization energy required per unit volume of the plasma is:

$$N_pE_i=10^{15}\times2.5\times10^{-18}=2.5\times10^{-3}\ \text{joule/cm}^3$$

Suppose the flue gas volume rate is 1,000 cfm. The volume rate of plasma required is then 0.1 cfm (since $V_p/V_f=10^{-4}$). The resulting rate of ionization energy required is then:

$$P_i=V_pN_pE_i=1.2\times10^{-1}\ \text{j/sec}=1.1\times10^{-1}\ \text{watt.}$$

Suppose the discharge efficiency is conservatively set at $10^{-2}$, the discharge power required is:

$$P_d=10^2P_i=12\ \text{watts}$$

Recall that this is the power required to charge the particles in a flue gas of 10 gm/m$^3$ particulate mass concentration and at 1,000 cfm. In the conventional electrostatic precipitator the power required would be about 1 kw. When power conversion efficiency is considered, the new method still requires much less power than the conventional method, since the conversion of line power to radio-frequency power can be accomplished at an efficiency of about 75%.

What is claimed is:

1. A method of enhancing the precipitation of particles entrained in a primary fluid stream flowing toward and in an electrostatic precipitation zone, that includes (a) generating a plasma in an auxiliary gaseous stream causing ionization of the auxiliary gaseous stream, (b) introducing the plasma into the primary fluid stream for charging the particles in said primary fluid stream, and (c) flowing into said precipitation zone said primary stream into which plasma has been introduced.

2. The method of claim 1 wherein said step of generating a plasma includes providing a duct in which the plasma is to be generated and locating the duct to discharge plasma into the primary fluid stream.

3. The method of claim 2 wherein said step of generating a plasma includes providing a coil proximate the duct and supplying r.f. energy to the coil to effect plasma generation in the auxiliary gas stream in the duct.

4. The method of one of claims 1, 2 or 3 wherein said auxiliary gas stream includes an inert gas.

5. The method of one of claims 2 or 3 wherein the auxiliary gas stream consists essentially of a gas selected from the group that includes air and nitrogen.

6. The method of claim 3 wherein said supplying of r.f. energy includes controlling the r.f. frequency between about 1 Mhz and 10 Ghz.

7. The method of claim 1 including maintaining in said zone a DC field between surfaces that include a precipitation surface.

8. In apparatus for enhancing the precipitation of particles entrained in a primary fluid stream flowing in a primary duct toward an electrostatic precipitation zone in an electrostatic precipator, said apparatus comprising (a) first means for generating a plasma in an auxiliary gaseous stream to cause ionization thereof, and (b) second means including a secondary duct communicating with said primary duct for conducting the plasma into said primary stream for charging the particles in said primary stream, (c) and including said precipitator in combination with said apparatus for receiving said primary stream into which the plasma has been introduced.

9. The apparatus of claim 8 wherein said secondary duct extends into said primary duct.

10. The apparatus of claim 9 wherein said first means includes a coil proximate the secondary duct and a source of r.f. energy connected with the coil to produce an r.f. magnetic field in the auxiliary gas stream in the secondary duct, thereby to produce the plasma.

11. The apparatus of one of claims 9 or 10 including auxiliary means supplying the auxiliary gas stream to flow in the secondary duct.

12. The apparatus of claim 10 wherein the secondary duct has a venturi section about which the coil extends, the secondary duct having an outlet located at a central portion of said primary duct.

13. The apparatus of one of claims 8 or 9 including auxiliary means for supplying said auxiliary gas wherein said auxiliary gas consists essentially of a gas selected from the group that includes air and nitrogen.

14. The apparatus of claim 10 wherein said source of r.f. energy includes circuitry controlling the r.f. frequency between about 1 Mhz and 10 Ghz.

15. The apparatus of claim 8 including means at said zone for maintaining a DC field between surfaces that include a particle precipitation surface of said electrostatic precipitator.

16. The apparatus of claim 15 including means for controlling said DC field in relation to the frequency of an r.f. discharge produced by said first means, thereby to optimize the particle precipitation.

17. The apparatus of claim 15 wherein said first means produces an r.f. discharge and includes means to control the frequency of r.f. energy supplied to produce said discharge, in relation to the strength of said DC field, thereby to optimize the particle precipitation.

* * * * *